US006468187B1

(12) United States Patent
Boatwright

(10) Patent No.: US 6,468,187 B1
(45) Date of Patent: Oct. 22, 2002

(54) METHOD FOR LEG AND CARDIOVASCULAR EXERCISE

(76) Inventor: Donald Jeffrey Boatwright, 5710 Mount Holly Huntersville Rd., Charlotte, NC (US) 28216

( * ) Notice: Subject to any disclaimer, the term of this patent is extended or adjusted under 35 U.S.C. 154(b) by 0 days.

(21) Appl. No.: 09/497,147

(22) Filed: Feb. 3, 2000

(51) Int. Cl.[7] ..... A63B 21/068; A63B 22/00
(52) U.S. Cl. ..... 482/95; 482/51; 482/96
(58) Field of Search ..... 482/51, 95, 96

(56) References Cited

U.S. PATENT DOCUMENTS 2,715,788 A * 8/1955 Gutshall ..... 242/530.2
4,700,945 A * 10/1987 Rader ..... 482/96
4,940,226 A * 7/1990 Carra ..... 482/51
5,114,387 A * 5/1992 Keppler ..... 482/51
5,425,691 A * 6/1995 Van Der Hoeven ..... 482/51
5,433,685 A * 7/1995 Winslow et al. ..... 482/96
5,462,506 A * 10/1995 Markland ..... 482/51
5,941,803 A * 8/1999 Chamberlain et al. ..... 482/51

* cited by examiner

*Primary Examiner*—Jerome W. Donnelly
*Assistant Examiner*—Victor K. Hwang

(57) ABSTRACT

A back slide exercise device for mounting to a vertical surface such as a wall for performing squatting exercises. The back slide exercise device has a slide portion with a smooth surface for slidingly supporting the back of a user performing squat-type exercises. Upper and lower rigid support members secured to the upper and lower edges of the slide surface are secured to the vertical surface by fasteners. A user performs squat exercises by leaning against the smooth outer surface of the slide portion with their back and extending their legs to move from a squat position to an upright position and then flexing their legs to move back to a squat position.

7 Claims, 2 Drawing Sheets

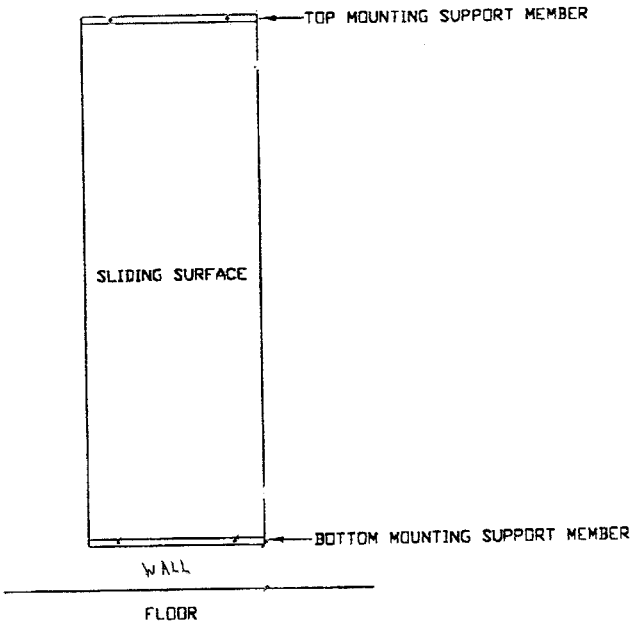
FRONT VIEW fig 6
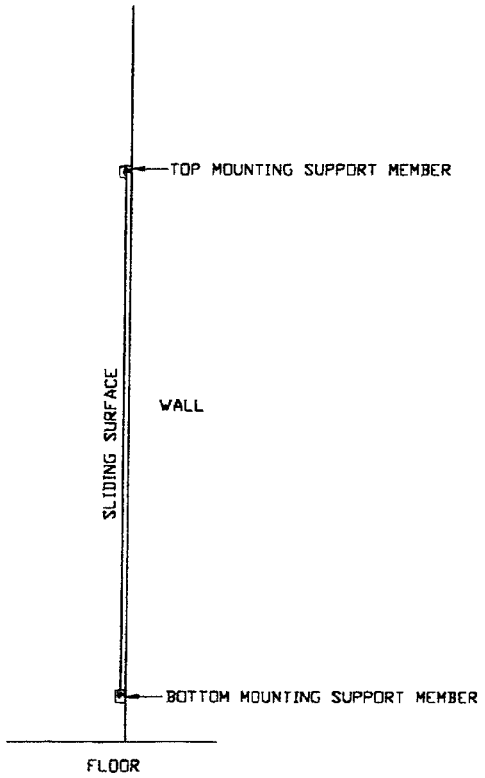
SIDE VIEW fig 5
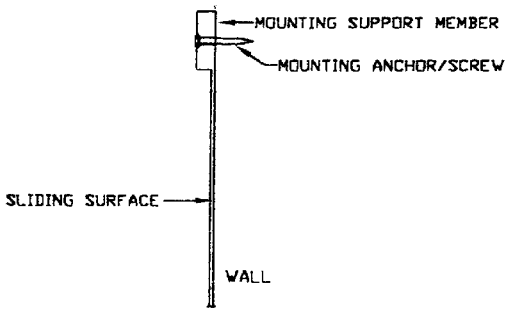
ENLARGED VIEW fig 4

METHOD FOR LEG AND CARDIOVASCULAR EXERCISE

FIELD OF THE INVENTION

The invention relates to the field of exercising equipment and in particular to those types of devices that provide resistance to the user that allows him to work against the weight of his own body or some portion of the weight of his own body.

In the invention described herein, a slick flat surface is provided and rests between the user's back and a vertical surface, such as a wall, wherein the surface allows for sliding movements, up and down against the wall and so allows the user to work his leg muscles including the quadriceps, hamstrings, gluteus muscles as well as other muscle groups associated with the squat type of leg exercises. The invention allows the user to perform the squat type of leg exercise without using heavy weights and also provides a very effective cardiovascular workout.

The invention thus provides a portable unit that can be quickly set up anywhere, against a wall in the home or office or other place where the user wants to exercise. After attaching the device to the wall the user simply leans back against the flat slick surface and bends his knees slowly in a squatting motion. The only other piece of equipment required is a shirt or jacket made of cotton or nylon or any material that is slippery against the flat surface of the device which will permit him to easily slide up and down while leaning back against the Back Slide device. It is believed that these advantages as well as others will accrue to the user's benefit and will encourage him to use the device to perform a healthy exercise.

PRIOR ART

There are no known devices that are similar in construction and allow the user to perform the squatting type of exercises in the manner described herein. In addition, there are no known exercise methods that allow the user to perform the leg exercises described herein with a modicum of equipment.

BACKGROUND OF THE INVENTION

It is believed that such a device as described herein will find its greatest use for those who do not have a lot of space of money for large heavy expensive equipment. This device will also be very beneficial for those people on the go since the device can be quickly set up against any wall at home or away from home. The capability of using a simple device that is not subject to failures of various components and one that can be set up in a small amount of wall space and without having to go through a series of time consuming steps in order to make it operable is likely to find wide appeal to many potential customers.

In addition, the device will not put undue strain on the legs or back or require the user to perform difficult movements that could increase the chance of injury. Such safety factors are paramount in this invention and are believed to be another advantage of the invention. Unlike typical squat devices, this device does not create a situation where there is weight above the user and upon his back. Also the device does not create a heavy load on the floor structure which can be a major concern in apartments or any multi-story building.

There are, no doubt, many possible users of the invention who would like an inexpensive, easy to use device that can provide an effective workout for the legs and associated muscles as well as provide a good cardiovascular workout. The flat surface of the device would also provide an ideal medium for sporting goods companies to place their logo or their custom graphics.

SUMMARY OF THE INVENTION

An exercise device and method of performing exercise using the device is shown and described herein. The device comprises a sliding surface or back plate having a smooth finish at least on one side and being of a rectangular shape. The device should be of a material that can support the force created by the friction of the user as he slides against the flat surface of the device. The flat sliding surface portion of the device should be of a flexible nature so as to allow the device to be rolled up for transport and/or for retail shipping and sales. The top and bottom mounting support members allow it to be attached into wall studs normally found in homes and offices. These mounting support members are made of a rigid material such as plastic and run parallel to the edges of the sliding surface. Wall anchors or screws may be used to secure the mounting support members to a wall such that the sliding surface is flat against the wall.

Other advantages of the invention will be known to those skilled in the art once the invention is shown and described.

DESCRIPTION OF DRAWINGS

FIG. 4 enlarged side view showing mounting screw;

FIG. 5 another side view;

FIG. 6 another front view.

DESCRIPTION OF THE PREFERRED EMBODIMENT

The invention comprises a flat sliding surface 2 that has at least two mounting support members (6 and 8) for mounting the flat surface to the wall. The sliding surface should have a smooth finish which allows the user to slide up or down in relation to the floor and along the mounted flat sliding surface. The surface material should be able to be rolled up for transport.

Figure 3:
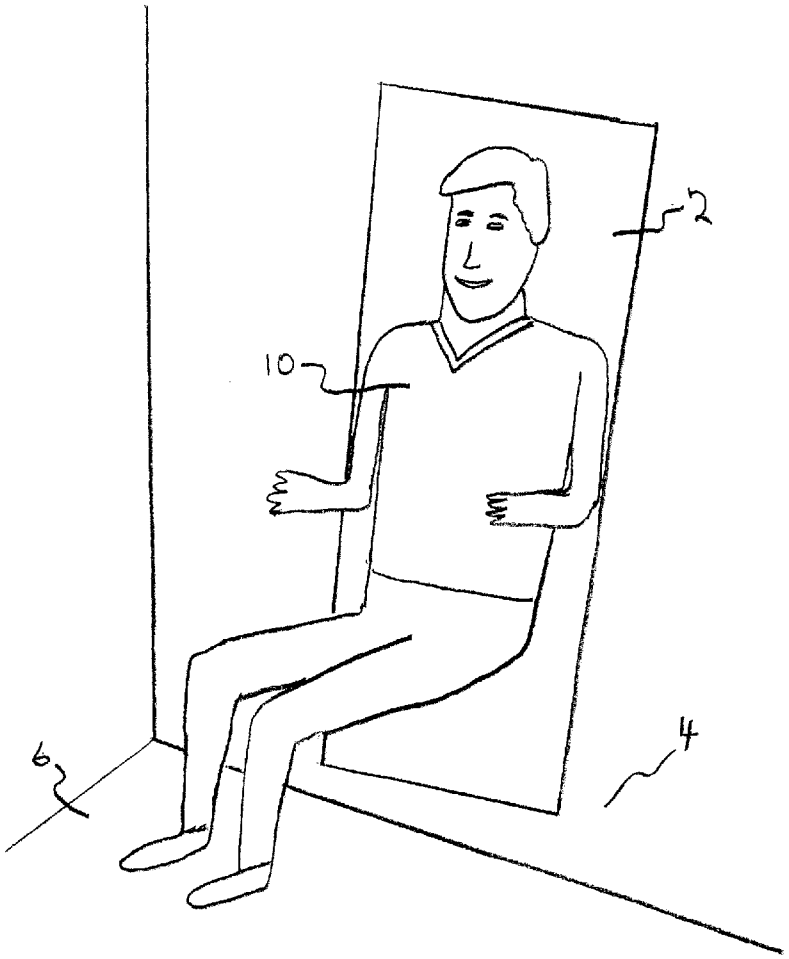
FIG. 3 apparatus in use.
Figure 2:
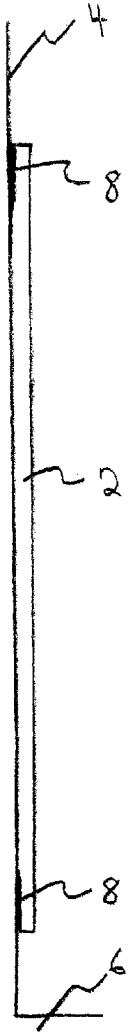
FIG. 2 side view.
Figure 1:
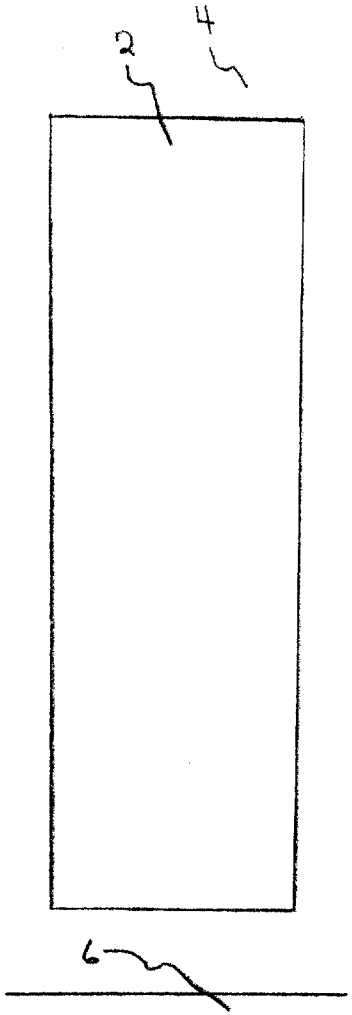
FIG. 1 front view.

The exact dimensions of the Back Slide invention can vary through trial and error associated with further refinement of the invention. An optimum dimension appears to be a width of approximately 24" and a height of approximately 72". It is important that the Back Slide be large enough to cover the area of the wall (10 in FIG. 3) that is associated with the user 12 and where he will be leaning against without hitting the upper and lower mounting support members. The surface is thus higher than it is wide and hence the upper edge and the lower edge of the device would be along the short sides of the rectangular surface.

The material that comprises the Back Slide should be chosen so that it can be readily rolled up for ease of transport and so that it can be packaged in this way for retail display and/or sales. It is thought that the preferred material for construction of the Back Slide would be of some type of flexible plastic. The flat sliding surface of the device will be attached to the upper and lower mounting support members of the device as shown on the attached drawings. The upper and lower mounting support members can be connected to the sliding surface by means of a permanent adhesive or fused to the flat siding surface in a two step process; or the mounting support members can be made integral to the flat sliding surface in a one step process.

It is believed that the flat sliding portion of the device, when manufactured, is likely to be between about 1/32" to 1/8" in thickness. The wall mounting support portion of the device may be simply two rigid pieces of plastic or other similar material and running along the top edge and along the bottom edge of the sliding surface portion. The upper and lower wall mounting support members of the device are likely to be about 1 inch in height and about 1/4 inch in thickness as shown on the attached drawing. See FIG. 4 for side view with mounting anchor or screw.

There should be at least two pre-formed or pre-drilled apertures 8 in the mounting support members to allow for placement of screws or sheet rock anchors or similar mechanisms through the holes and into wall studs to thereby support the device. Thus, it is preferred that the holes in the upper and lower mounting support members be spaced apart about 16" so as to allow for typical spacing between wall studs. And thus allow the screws and anchors to be used to attach the surface to two wall studs.

Installing the device would entail attaching the support members to the studs in the walls by the anchors already mentioned. The long sides of the rectangular sliding surface would then be in the vertical orientation in relationship to the user and the shorter upper and lower edges would be seen as top and bottom edges of the device. When in place, the bottom edge should be about 6" above the level of the floor.

After the device has been installed, the user is ready to use it in his regular exercise routine. It is suggested that when the user is ready to use the invention, he should wear a cotton or nylon shirt or clothing of similar texture that will allow the user to slide up and down across the Back Slide surface.

The user can spread his feet and legs apart to a distance that appears reasonable, typically shoulder width, it is thought that the user's heels should be anywhere from 6" to 30" away from the wall. As the heels get closer to the wall the exercise will be easier. The distance between the heels and the wall and the amount of spread between the feet will determine how much each muscle group is exercised. As the user leans back against the flat sliding surface of the Back Slide and raises and lowers his body, the amount of knee bend and the speed at which the user performs this exercise will also determine how much each muscle group is exercised as well as how much cardiovascular exercise is experienced. The specific level of knee bend, the specific placement of the feet, and the specific speed of the exercise will be determined by each individual's level of fitness. Users should exercise caution and get medical recommendations about what levels of exercise are proper for the invention.

I claim:

1. A method of performing leg and cardiovascular exercise comprising the steps of:

(a) providing a back slide exercise device comprising a slide portion made of a substantially rectangular piece of flexible material having a substantially smooth outer surface between upper and lower rigid support members;

(b) securing the upper and lower rigid support members to a vertical surface with fasteners to present the smooth outer surface of the slide portion as a substantially vertical, planar surface between the upper and lower rigid support members;

(c) positioning the back of a user against the smooth outer surface of the back slide exercise device by leaning backwards against the back slide device;

(d) the user extending their legs to raise their body in a standing motion while having their back slidingly supported by the smooth outer surface of the back slide device; and (e) the user flexing their legs to lower their body in a squatting motion while having their back slidingly supported by the smooth outer surface of the back slide device.

2. The method of performing leg and cardiovascular exercise of claim 1, wherein step (a) further comprises unrolling the back slide exercise device from a coiled configuration.

3. The method of performing leg and cardiovascular exercise of claim 1, wherein the user is wearing upper body clothing made of material having low friction with respect to the smooth outer surface of the slide portion so that the clothing material worn by the user slides relative to the smooth outer surface of the slide portion during the exercise without significant resistance.

4. The method of performing leg and cardiovascular exercise of claim 3, wherein the clothing is made of cotton or nylon material.

5. The method of performing leg and cardiovascular exercise of claim 1, wherein step (b) further includes positioning the lower rigid support member at a location on the vertical surface about 6 inches above a floor surface upon which the user is supported.

6. The method of performing leg and cardiovascular exercise of claim 1, wherein the step of securing the upper and lower rigid support members to the vertical surface with fasteners comprises securing the fasteners to wall studs.

7. The method of performing leg and cardiovascular exercise of claim 1, wherein step (c) further includes placement of the heels of the user between 6 inches and 30 inches away from the vertical surface.

* * * * *